US007755549B2

(12) United States Patent
Cheng

(10) Patent No.: US 7,755,549 B2
(45) Date of Patent: Jul. 13, 2010

(54) CARRIER WITH SOLID ANTENNA STRUCTURE AND MANUFACTURING METHOD THEREOF

(75) Inventor: Hung-Hsiang Cheng, Kaohsiung (TW)

(73) Assignee: Advanced Semiconductor Engineering, Inc., Nantze Export Processing Zone, Kao-Hsiung (TW)

( * ) Notice: Subject to any disclaimer, the term of this patent is extended or adjusted under 35 U.S.C. 154(b) by 67 days.

(21) Appl. No.: 11/943,595

(22) Filed: Nov. 21, 2007

(65) Prior Publication Data

US 2008/0158080 A1 Jul. 3, 2008

(30) Foreign Application Priority Data

Dec. 29, 2006 (TW) ..... 95149876 A

(51) Int. Cl.
*H01Q 1/24* (2006.01)

(52) U.S. Cl. ..... 343/702; 343/767; 343/770

(58) Field of Classification Search ..... 343/700 MS, 343/702, 785, 741, 866, 767, 770
See application file for complete search history.

(56) References Cited

U.S. PATENT DOCUMENTS

| | | | | |
|---|---|---|---|---|
| 6,239,762 | B1 * | 5/2001 | Lier | 343/770 |
| 6,388,632 | B1 * | 5/2002 | Murakawa et al. | 343/770 |
| 7,057,564 | B2 * | 6/2006 | Tsai et al. | 343/700 MS |
| 7,528,788 | B2 * | 5/2009 | Dunn et al. | 343/795 |

FOREIGN PATENT DOCUMENTS

| | | |
|---|---|---|
| TW | I255073 | 5/2006 |
| TW | I263377 | 10/2006 |

* cited by examiner

*Primary Examiner*—James H. Cho
*Assistant Examiner*—Christopher Lo
(74) *Attorney, Agent, or Firm*—Winston Hsu

(57) ABSTRACT

Carrier with solid antenna structure comprises a substrate and at least one solid antenna structure. The substrate has an upper surface, a lower surface, at least one first slot communicating with the upper surface and the lower surface and at least one second slot communicating with the upper surface and the lower surface. The solid antenna structure has a dielectric block formed between the first slot and the second slot and a radiation conductor, in which the dielectric block encloses the radiation conductor. In this invention, the solid antenna structure is used to enable the carrier to be applied to higher power transmission. Additionally, by setting the material of the dielectric block and optimizing the size of the radiation conductor, the carrier can be applied to multi-band.

19 Claims, 6 Drawing Sheets

CARRIER WITH SOLID ANTENNA STRUCTURE AND MANUFACTURING METHOD THEREOF

BACKGROUND OF THE INVENTION

1. Field of the Invention

The invention relates to a carrier, and more particularly, to a carrier having solid antenna.

2. Description of the Prior Art

Most antennae used on conventional carriers are fabricated with a plane structure, and the fabrication of the antennae is accomplished by forming antenna conductors (such as micro-bands) on a top surface and a bottom surface of the carrier. However, the conventional antennae characterized with plane structure are designated for transmitting single frequency signals, and are inadequate to be applied to transmit multi-frequency signals. Moreover, the asymmetrical design of the conventional antennae also causes poor directivity to magnetic field, which further adds more difficulty to their usage in transmitting high frequency signals.

SUMMARY OF THE INVENTION

It is an objective of the present invention to provide a carrier with solid antenna structure and fabricating method thereof. The carrier preferably includes a substrate and at least one solid antenna structure. The substrate has an upper surface, a lower surface, and at least one first slot and second slot communicating with the upper surface and the lower surface. The solid antenna structure has a dielectric block formed between the first slot and the second slot and a radiation conductor enclosing the dielectric block. Specifically, the utilization of the solid antenna structure facilitates the application of the carrier to high power transmission. By selecting different material for the dielectric block and optimizing the size of the radiation conductor, the carrier can be used in multi-band applications.

A carrier having solid antenna structure of the present invention preferably includes a substrate and at least one solid antenna structure. The substrate has an upper surface, a lower surface, and at least one first slot and second slot communicating with the upper surface and the lower surface. The solid antenna structure has a dielectric block and a radiation conductor. The dielectric block is formed between the first slot and the second slot and enclosed by the radiation conductor.

A method for fabricating a carrier with solid antenna structure of the present invention includes the steps of: providing a substrate having an upper surface, a lower surface, at least one first slot and at least one second slot, a first conductive layer formed on the upper surface of the substrate, a second conductive layer formed on the lower surface of the substrate, and a dielectric block formed between the first and the second slot, in which the first slot and the second slot are formed on two sides of the first conductive layer and the second conductive layer to communicate with the upper surface and the lower surface of the substrate; and forming a third conductive layer in the first slot and forming a fourth conductive in the second slot, in which the third conductive layer and the fourth conductive layer are connected to the first conductive layer and the second conductive layer, and the first conductive layer, the second conductive layer, the third conductive layer, and the fourth conductive layer form a radiation conductive enclosing the dielectric block.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
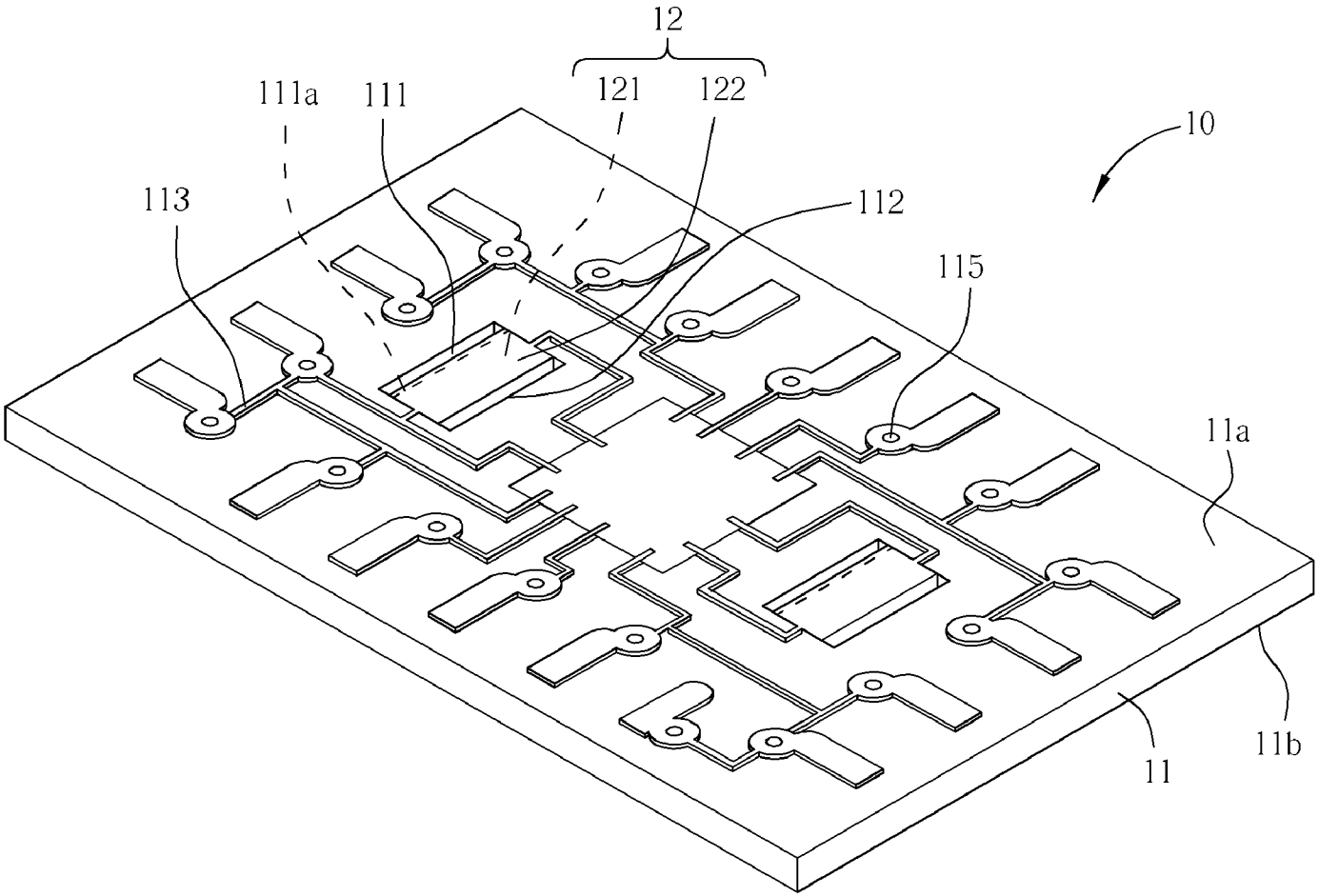
FIG. 1 illustrates a carrier with solid antenna structure according to a preferred embodiment of the present invention.
Figure 2:
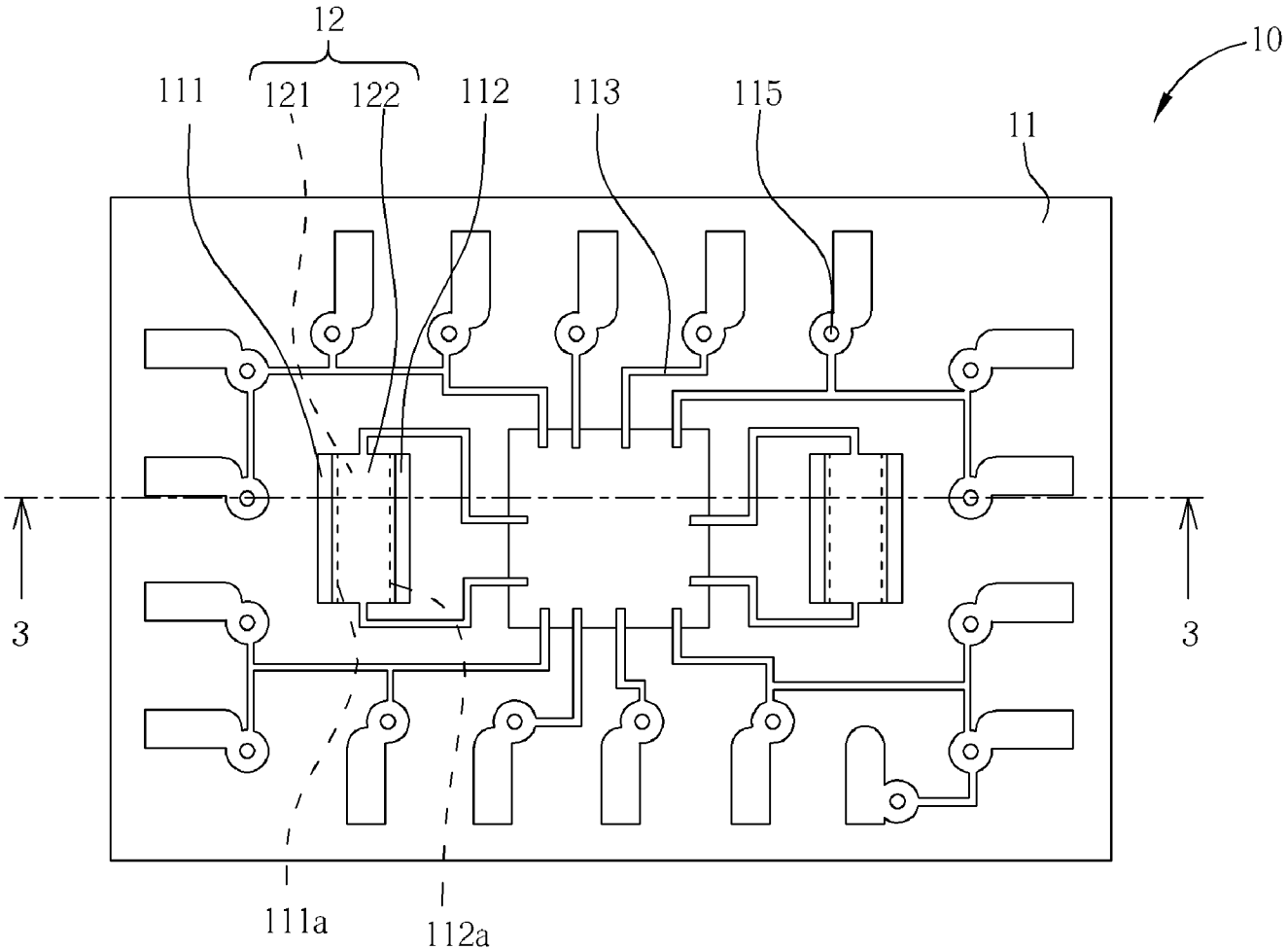
FIG. 2 illustrates a front view of a carrier according to a preferred embodiment of the present invention.
Figure 3:
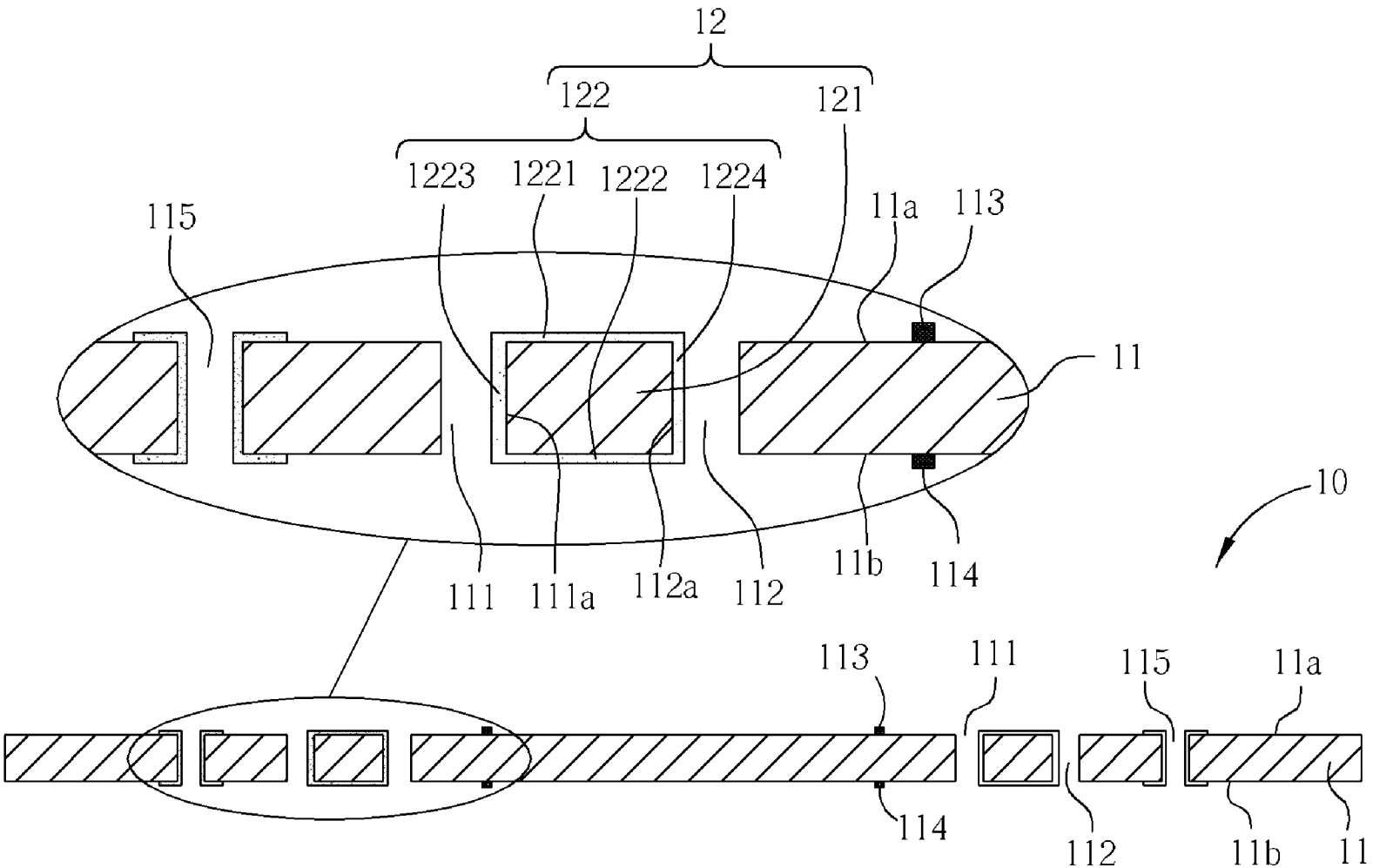
FIG. 3 illustrates a cross-section of the carrier shown in FIG. 2 along the sectional line 3-3.

Referring to FIGS. 1-3. FIGS. 1-3 illustrate a carrier with solid antenna structure according to a preferred embodiment of the present invention. The carrier 10 preferably includes a substrate 11 and at least an antenna structure 12. The substrate 11 has an upper surface 11*a*, a lower surface 11*b*, and at least one first slot 111 and second slot 112 communicating with the upper surface 11*a* and the lower surface 11*b*. The first slot 111 and the second slot 112 can be rectangular, circular, elliptical, or other geometric shapes. In this embodiment, the first slot 111 and the second slot 112 are rectangular.

The first slot 111 and the second slot 112 have a first sidewall 111*a* and a second sidewall 112*a* respectively. The antenna structure 12 has a dielectric block 121 and a radiation conductor 122, in which the dielectric block 121 is formed between the first slot 111 and the second slot 112. Preferably, the dielectric block 121 and the substrate 11 are formed in unity, and the radiation conductor 122 is formed to enclose the dielectric block 121. The radiation conductor 122 is comprised of a first conductive layer 1221, a second conductive layer 1222, a third conductive layer 1223, and a fourth conductive layer 1224. The first conductive layer 1221 is formed on the upper surface 11*a* of the substrate 11, the second conductive layer 1222 is formed on the lower surface 11*b* of the substrate 11, the third conductive layer 1223 is formed on the first sidewall 111*a* of the first slot 111, and the fourth conductive layer 1224 is formed on the second sidewall 112*a* of the second slot 112. Preferably, the radiation conductor 122 is made of copper. The antenna structure 12 of this embodiment has a better magnetic directivity, such that the antenna can be used to receive or transmit high frequency electromagnetic signals toward a particular direction.

Referring to FIGS. 1 and 3, the upper surface 11*a* and the lower surface 11*b* of the substrate 11 has a first wiring layer 113 and a second wiring layer 114 respectively. In this embodiment, the radiation conductor 122 is electrically connected to the first wiring layer 113 and the second wiring layer 114. The substrate 11 also has another through hole 115 communicating with the upper surface 11*a* and the lower surface 11*b*, and at the same time electrically connecting the first wiring layer 113 and the second wiring layer 114.

Figure 4:
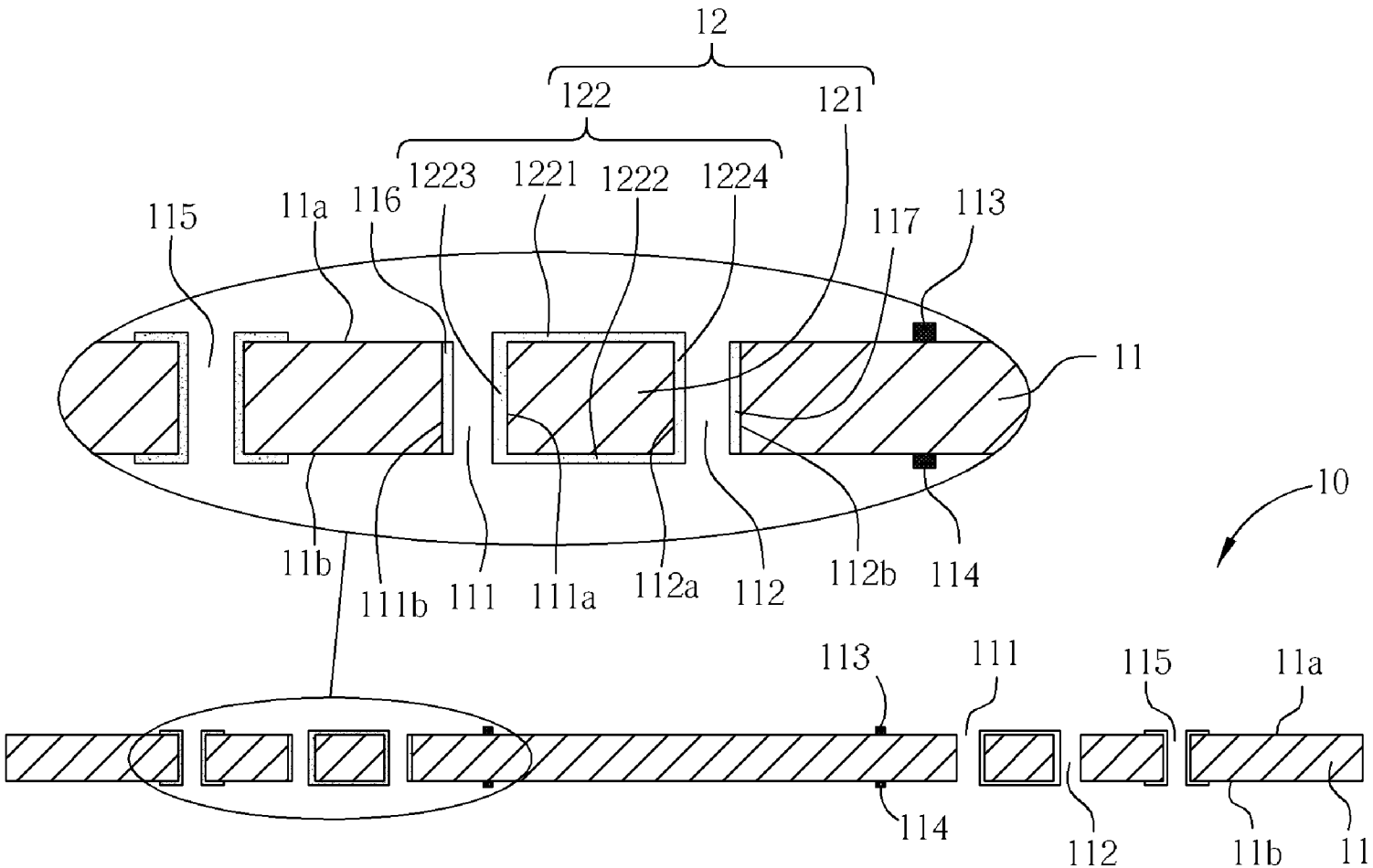
FIG. 4 illustrates a cross-section of a carrier with solid antenna structure according to an embodiment of the present invention.

According to another embodiment of the present invention, as shown in FIG. 4, a first metal layer 116 is formed on a third sidewall 111*b* of the first slot 111 and a second metal layer 117 is formed on a fourth sidewall 112*b* of the second slot 112. The first metal layer 116 and the second metal layer 117 can be used to shield the interference caused by electromagnetic waves or other electrical signals.

Figure 5A:
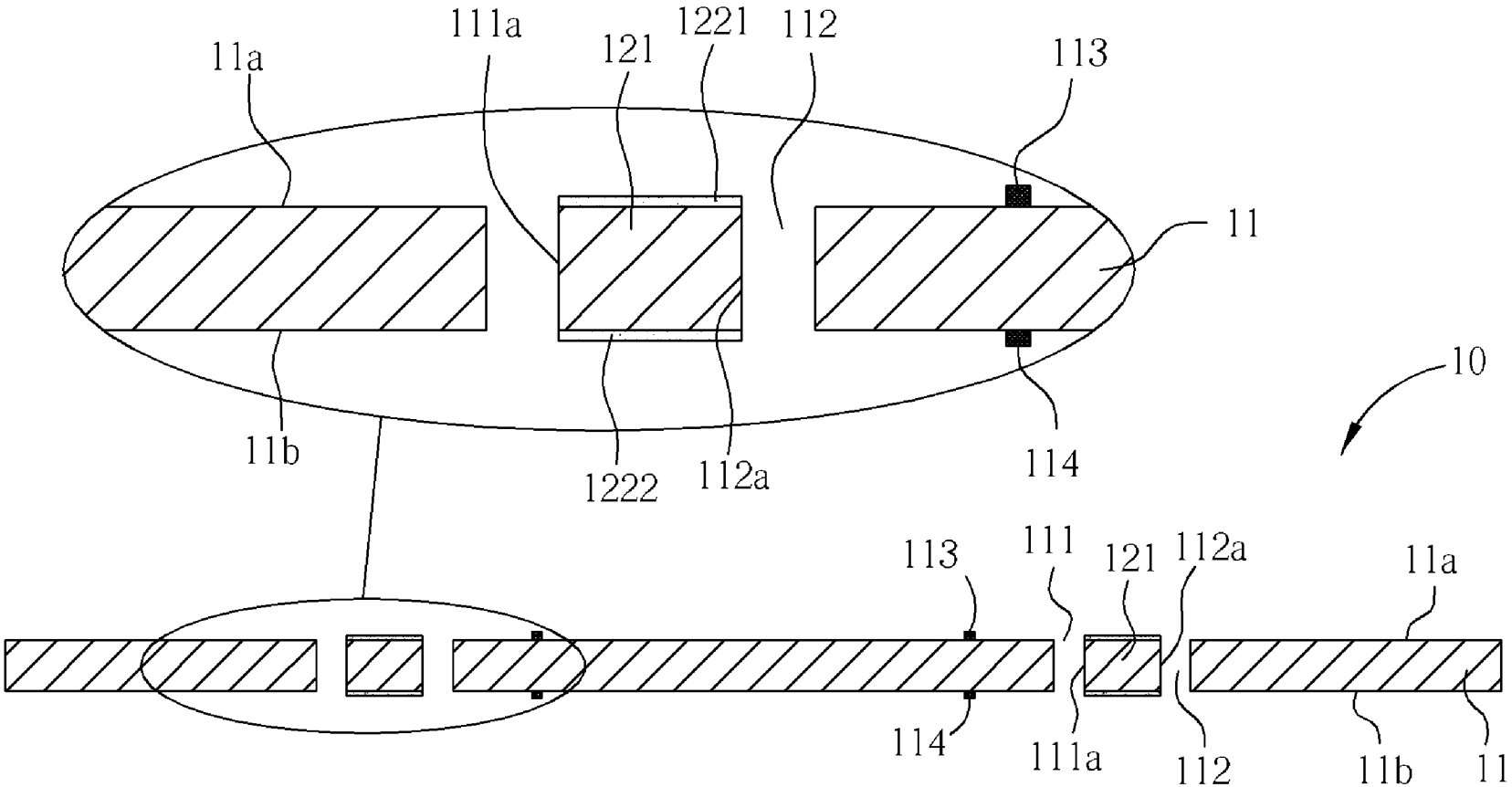
FIGS. 5A-5B illustrate a method for fabricating a carrier with solid antenna structure according to a preferred embodiment of the present invention.
Figure 5B:
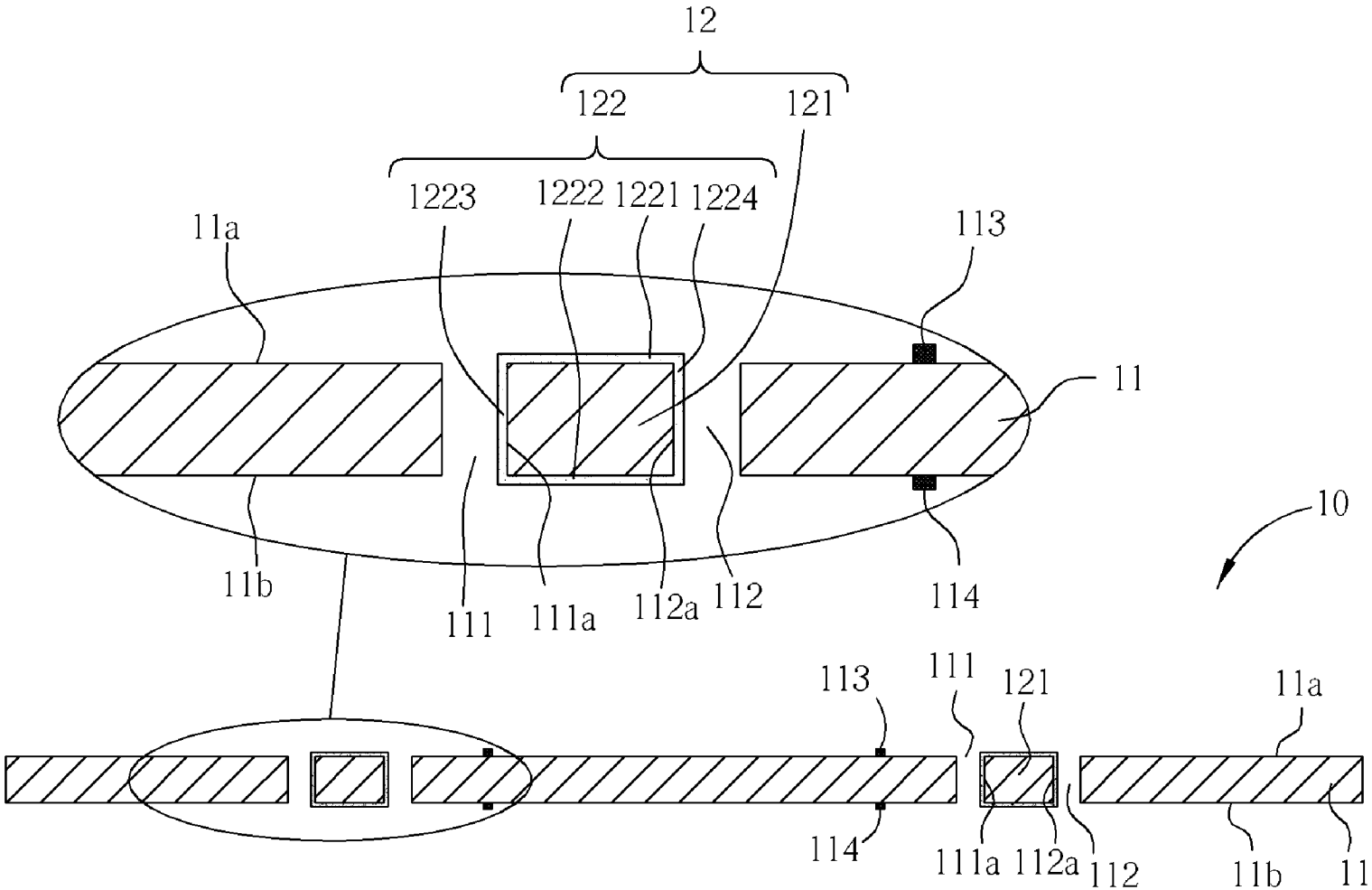

A method for fabricating the carrier 10 of the present invention is illustrated in FIGS. 5A-5B. As shown in FIG. 5A, a substrate 11 having an upper surface 11*a*, a lower surface 11*b*, at least a first slot 111 and at least a second slot 112 is first provided.

A first conductive layer 1221 is then formed on the upper surface 11*a* of the substrate 11, and a second conductive layer 1222 is formed on the lower surface 11*b* of the substrate 11. The first slot 111 and the second slot 112 are positioned adjacent to the first conductive layer 1221 and the second conductive layer 1222 and communicating with the upper surface 11*a* and the lower surface 11*b*. A dielectric block 121 is formed between the first slot 111 and the second slot 112. Preferably, the dielectric block 121 and the substrate 11 are formed in unity. In this embodiment, the first slot 111 and the second slot 112 are rectangular, in which the first slot 111 and the second slot 112 can be formed by mechanical processes or laser processes. The first slot 111 and the second slot 112 also have a first sidewall 111*a* and a second sidewall 112*a* respectively.

Next, as shown in FIG. 5B, a third conductive layer 1223 is formed on the first sidewall 111*a* of the first slot 111 and a fourth conductive layer 1224 is formed on the second sidewall 112*a* of the second slot 112. The third conductive layer 1223 and the fourth conductive layer 1224 are connected to the first conductive layer 1221 and the second conductive layer 1222, such that the first conductive layer 1221, the second conductive layer 1222, the third conductive layer 1223, and the fourth conductive layer 1224 would form a radiation conductor 122 to enclose the dielectric block 121. In this embodiment, the dielectric block 121 and the radiation conductor 122 are utilized to form a solid antenna structure 12. The dielectric block 121 and the substrate 11 can be composed of same or different material. Preferably, the radiation conductor 122 is made of copper.

Specifically, the incorporation of the solid antenna structure 12 of the present invention into the carrier 10 could be utilized for high frequency signal transmissions, and by using different material to fabricate the dielectric block 121 and fabricate the radiation conductor 122 with different sizes, the carrier 10 of the present invention could be applied for multi-band usages. Moreover, the method of the present invention for fabricating the carrier 10 not only ensures a simplified fabrication process and lowered cost, but also enhances the integration with integrated circuit designs.

Those skilled in the art will readily observe that numerous modifications and alterations of the device and method may be made while retaining the teachings of the invention.

What is claimed is:

1. A carrier with a solid antenna structure, comprising:

a substrate having an upper surface, a lower surface, at least one first slot communicating with the upper surface and the lower surface, and at least one second slot communicating with the upper surface and the lower surface; and at least one solid antenna structure having a dielectric block and a radiation conductor, wherein the dielectric block is disposed between the first slot and the second slot and the radiation conductor encloses the dielectric block without exposing any surface of the dielectric block.

2. The carrier with a solid antenna structure of claim 1, wherein the radiation conductor comprises a first conductive layer, a second conductive layer, a third conductive layer, and a fourth conductive layer, wherein the first conductive layer is formed on the upper surface of the substrate, the second conductive layer is formed on the lower surface of the substrate, the third conductive layer is formed in the first slot, and the fourth conductive layer is formed in the second slot.

3. The carrier with a solid antenna structure of claim 2, wherein the first slot comprises a first sidewall, the second slot comprises a second sidewall, the third conductive layer is formed on the first sidewall of the first slot, and the fourth conductive layer is formed on the second sidewall of the second slot.

4. The carrier with a solid antenna structure of claim 1, wherein the dielectric block and the substrate are formed in unity.

5. The carrier with a solid antenna structure of claim 1, wherein the radiation conductor is made of copper.

6. The carrier with a solid antenna structure of claim 1, wherein the first slot comprises rectangular, circular, elliptical, or other geometric shapes.

7. The carrier with a solid antenna structure of claim 1, wherein the second slot comprises rectangular, circular, elliptical, or other geometric shapes.

8. The carrier with a solid antenna structure of claim 1, wherein the upper surface of the substrate comprises a first wiring layer electrically connected to the radiation conductor.

9. The carrier with a solid antenna structure of claim 1, wherein the lower surface of the substrate comprises a second wiring layer electrically connected to the radiation conductor.

10. The carrier with a solid antenna structure of claim 1, wherein the first slot comprises a third sidewall having a first metal layer thereon, and the second slot comprises a fourth sidewall having a second metal layer thereon.

11. A method for fabricating a carrier with solid antenna structure, comprising:

providing a substrate having an upper surface, a lower surface, and at least one first slot and at least one second slot, a first conductive layer formed on the upper surface of the substrate, a second conductive layer formed on the lower surface of the substrate, and a dielectric block formed between the first slot and the second slot, wherein the first slot and the second slot are formed on two sides of the first conductive layer and the second conductive layer to communicate with the upper surface and the lower surface of the substrate; and forming a third conductive layer in the first slot and forming a fourth conductive layer in the second slot, wherein the third conductive layer and the fourth conductive layer are connected to the first conductive layer and the second conductive layer, and the first conductive layer, the second conductive layer, the third conductive layer, and the fourth conductive layer form a radiation conductor for enclosing the dielectric block.

12. The method of claim 11, wherein the first slot comprises a first sidewall, the second slot comprises a second sidewall, the third conductive layer is formed on the first sidewall of the first slot, and the fourth conductive layer is formed on the second sidewall of the second slot.

13. The method of claim 11 further comprising forming the dielectric block and the substrate in unity.

14. The method of claim 11, wherein the radiation conductor is made of copper.

15. The method of claim 11, wherein the first slot comprises rectangular, circular, elliptical, or other geometric shapes.

16. The method of claim 11, wherein the second slot comprises rectangular, circular, elliptical, or other geometric shapes.

17. The method of claim 11 further comprising forming a first wiring layer on the upper surface of the substrate, wherein the first wiring layer is electrically connected to the radiation conductor.

18. The method of claim 11 further comprising forming a second wiring layer on the lower surface of the substrate, wherein the second wiring layer is electrically connected to the radiation conductor.

19. The method of claim 11, wherein the first slot comprises a third sidewall having a first metal layer thereon, and the second slot comprises a fourth sidewall having a second metal layer thereon.

* * * * *